US008579280B2

(12) United States Patent
Ishikuro

(10) Patent No.: US 8,579,280 B2
(45) Date of Patent: Nov. 12, 2013

(54) IMAGE FORMING APPARATUS

(75) Inventor: Takemasa Ishikuro, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/488,426

(22) Filed: Jun. 4, 2012

(65) Prior Publication Data

US 2012/0313318 A1 Dec. 13, 2012

(30) Foreign Application Priority Data

Jun. 7, 2011 (JP) ..... 2011-127367

(51) Int. Cl.
*B65H 29/00* (2006.01)

(52) U.S. Cl.
USPC ..... 271/186; 271/184; 271/185

(58) Field of Classification Search
USPC ..... 271/207, 209, 184–186, 220, 225
See application file for complete search history.

(56) References Cited

U.S. PATENT DOCUMENTS 5,014,976 A * 5/1991 Muck et al. ..... 271/220
6,983,122 B2 * 1/2006 Hayamizu et al. ..... 399/405
7,677,557 B2 * 3/2010 Ino ..... 271/220
8,448,941 B2 * 5/2013 Narikiyo ..... 271/185
2009/0108517 A1 * 4/2009 Guerand et al. ..... 271/225
2011/0042890 A1 * 2/2011 Lee et al. ..... 271/314
2011/0221124 A1 * 9/2011 Narikiyo ..... 271/225

FOREIGN PATENT DOCUMENTS

JP 2008-239334 A 10/2008

* cited by examiner

*Primary Examiner* — Prasad Gokhale
(74) *Attorney, Agent, or Firm* — Rabin & Berdo, P.C.

(57) ABSTRACT

An image forming apparatus can include an image forming member that forms an image on a sheet, an ejecting transport member that can transport the sheet in first and second directions, and a switching unit. The guide member can move to a first predetermined position and a second predetermined position. At the first predetermined position, the guide member can apply a pushing force to the sheet. At the second predetermined position, the guide member can either apply a smaller pushing force to the sheet than at the first predetermined position, or provide a clearance between the guide member and the sheet. The switching unit can switch the guide member into the first and second predetermined positions based on the sheet transporting direction of the ejecting transport member.

10 Claims, 13 Drawing Sheets

IMAGE FORMING APPARATUS

CROSS-REFERENCE TO RELATED APPLICATION

This application claims priority under 35 U.S.C. §119 from Japanese Patent Application NO. P 2011-127367, filed on Jun. 7, 2011, the disclosure of which is incorporated herein by reference.

BACKGROUND

1. Technical Field

This application relates to an image forming apparatus, such as a copy machine or a page printer.

2. Description of the Related Art

Japanese Laid-Open Patent No. 2008-239334 describes a pushing member that pushes a sheet toward a tray of an image forming apparatus being arranged at an ejecting member of the image forming apparatus to control a curling of the sheet ejected onto the tray.

However, in this image forming apparatus, the transport obliquely of the sheet might occur by a transport friction applied to the sheet while the sheet contacts the pushing member. Therefore, a transport defect may occur.

SUMMARY

This application relates to an image forming apparatus that can decrease an occurrence of the transport defect.

According to one aspect, an image forming apparatus can include an image forming member configured to form an image on a sheet, an ejecting transport member configured to transport the sheet in a first direction in which the sheet is ejected from the image forming apparatus, and in a second direction in which the sheet is transported to the image forming member. The image forming apparatus can further include a guide member configured to guide the sheet ejected by the ejecting transport member, and a switching unit. The guide member can move to at least one of a first predetermined position or a second predetermined position. At the first predetermined position, the guide member can apply a pushing force to the sheet, and at the second predetermined position, the guide member can one of apply a pushing force to the sheet that is smaller than the pushing force at the first predetermined position, or provide a clearance between the guide member and the sheet (e.g., the guide member does not contact the sheet at the second predetermined position during the ejection of the sheet). Also, based on the ejecting transport member transporting the sheet in the first direction, the switching unit can cause the guide member to move into the first predetermined position, and based on the ejecting transport member transporting the sheet in the second direction, the switching unit can cause the guide member to move into the second predetermined position.

BRIEF DESCRIPTION OF THE DRAWINGS

The image forming apparatus will be more fully understood from the following detailed description with reference to the accompanying drawings, which are given by way of illustration only, and are not intended to limit.

DETAILED DESCRIPTION

First Embodiment

Figure 1:
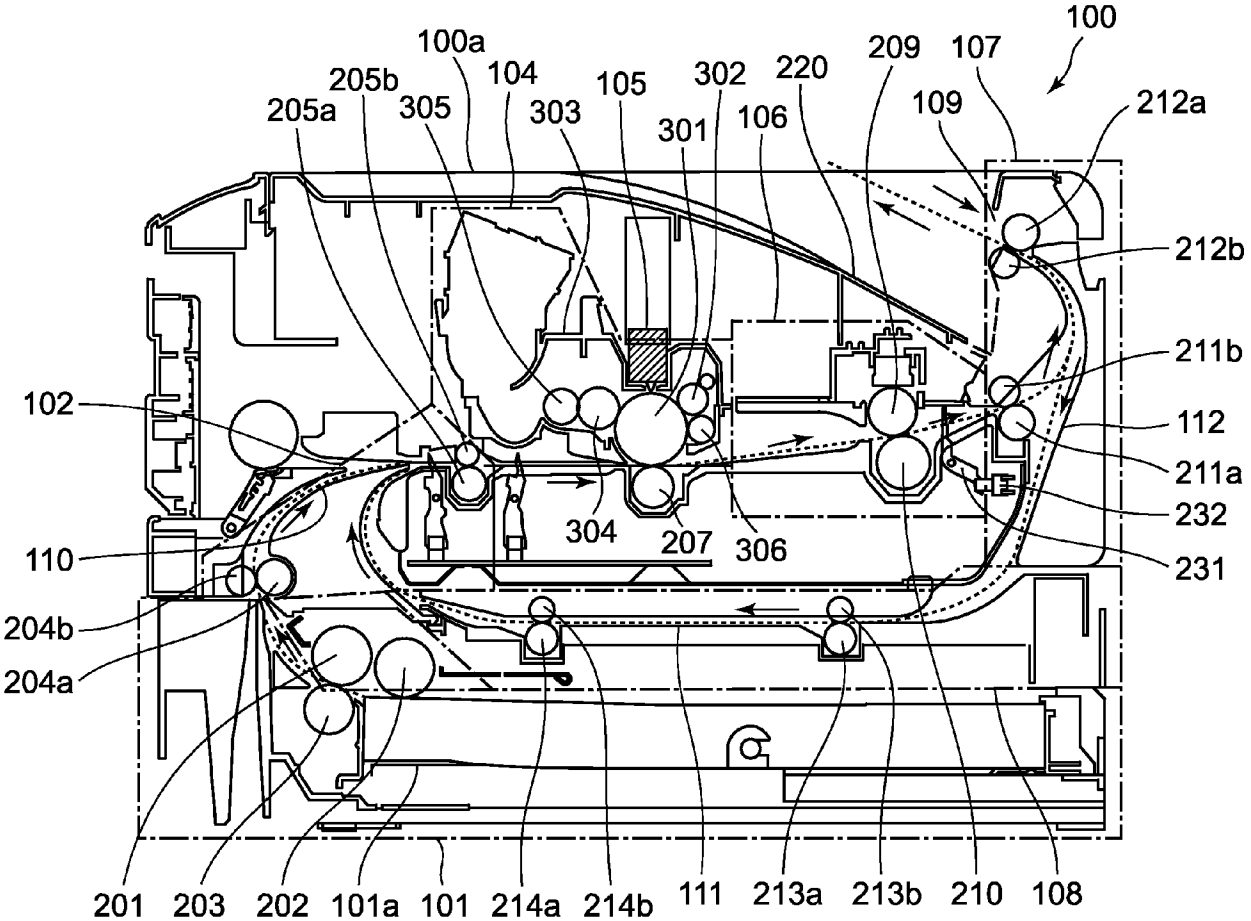
FIG. 1 is a schematic view illustrating the basic structure of a printer serving as the image forming apparatus according to a first embodiment.

FIG. 1 is a schematic view illustrating the basic structure of a printer 100*a* serving as an image forming apparatus 100 according to a first embodiment. The image forming apparatus 100 according to the first embodiment can serve as an electro-photographic printer that includes at least one LED (light emitting diode). In the first embodiment, a mono color electro-photographic printer as the printer 100 will be described. However, a color electro-photographic printer can be used instead of the mono color electro-photographic printer.

The printer 100*a* can include a supplying cassette 101 serving as a sheet supplying unit that stores a printing sheet serving as a medium (e.g., a medium such as paper or other medium capable of receiving an image). A sheet receiving board 101*a* can be arranged on the supplying cassette 101 so that the sheet receiving board 101*a* can swing on a predetermined axis. Also, the sheet receiving board 101*a* can be pushed toward an upper side of the printer 100*a* by a spring (not illustrated).

In an upper side of the supplying cassette 101, a pick-up roller 202 can be arranged to supply the sheet stored on the supplying cassette 101 to rollers. A supplying roller 201 and a separating roller 203 can be arranged in the vicinity of the pick-up roller 202 so as to separate and supply individual sheets to a transport path 110. The sheet stored on the sheet receiving board 101*a* can contact the pick-up roller 202 due to a pushing force of the sheet receiving board 101*a* caused by a spring. The pick-up roller 202 and the supplying roller 201 can rotate by the driving of a main motor 881 (described later with reference to FIG. 4).

A transport roller 204*a* and a pinch roller 204*b* that can transport the sheet to an image drum unit 104 serving as an image forming member can be arranged on the transport path 110. The transport roller 204*a* can rotate by the driving of the main motor 881. The pinch roller 204*b* can be pushed toward the transport roller 204*a*, and can rotate with the rotation of the transport roller 204*a*.

A registration roller 205*a* and a pressure roller 205*b* that can supply the sheet to the image drum unit 104 after fixing a skew, if any, of the sheet can be arranged along the transport path upstream of the image drum unit 104 in a sheet transport direction. The registration roller 205*a* can rotate by the driving of the main motor 881. The pressure roller 205*b* can be pushed toward the registration roller 205*a*, and can rotate with the rotation of the registration roller 205*a*.

A transport unit 102 can include the transport roller 204*a*, the pinch roller 204*b*, the registration roller 205*a*, and the pressure roller 205*b*.

The image drum unit 104 can include an image drum 301 serving as an image carrier. An LED head 105 can be arranged on an upper side of the image drum unit 104. The LED head 105 can serve as an exposure device, exposing a surface of the image drum 301 by controlling a head controller 850 (described later with reference to FIG. 4), and forming an electrostatic latent image based on image data.

The image drum 301 can rotate in a counterclockwise fashion. A charging roller 302, a developing unit 303, and a cleaning roller 306 can be arranged around the image drum 301. The charging roller 302 serving as a charging device can uniformly charge the surface of the image drum 301. The developing unit 303 can develop the electrostatic latent image formed on the surface of the image drum 301. The cleaning roller 306 can clean toner attached to the surface of the image drum 301 after transferring a toner image (described later).

A charging voltage can be applied to the charging roller 302 by a charging voltage controller 840 (described later with reference to FIG. 4) to uniformly charge the surface of the image drum 301. The developing unit 303 can include a developing roller 304 and a supplying roller 305. The developing roller 304 can supply a toner serving as a developer to the surface of the image drum 301. The supplying roller 305 can supply the toner to the developing roller 304. Also, a developing voltage can be applied to the developing roller 304 by a developing voltage controller 860 (described later with reference to FIG. 4) to attach the toner to the electrostatic latent image on the surface of the image drum 301.

The image drum 301 can rotate by the driving of the main motor 881. The developing roller 304, the supplying roller 305, and the cleaning roller 306 can rotate by a rotational transmission from the image drum 301. Since the charging roller 302 can contact the surface of the image drum 301, the charging roller 302 can rotate with the rotation of the surface of the image drum 301.

A fusing unit 106 can be arranged along the transport path downstream of the image drum unit 104. The fusing unit 106 can include a fusing roller 209 that has a heater, and a pushing roller 210 that pushes the sheet therebetween. The fusing roller 209 can rotate by the driving of the main motor 881. The pushing roller 210 can be pushed toward the fusing roller 209, and can rotate with the rotation of the fusing roller 209. The fusing roller 209 and the pushing roller 210 can fuse the toner to the sheet by the toner melting due to adding a heat and a pressure to a toner image on the sheet.

An ejecting unit 107 serving as a transporting unit that transports and ejects the sheet on which the toner image is fused can be arranged on an outer side of the printer 100*a* along the transport path 110 downstream of the fusing unit in the sheet transport direction. The ejecting unit 107 can include transport rollers 211*a* and 211*b*, and ejecting rollers 212*a* and 212*b* serving as an ejecting transport member. The transport rollers 211*a* and 211*b* can transport a sheet that passed through the fusing unit 106 toward an ejecting aperture 109. The ejecting rollers 212*a* and 212*b* can be arranged in the vicinity of the ejecting aperture 109.

The transport roller 211*a* can rotate in a direction to transport the sheet that passed through the fusing unit 106 toward the ejecting aperture 109. The ejecting roller 212*a* can rotate in both a forward direction to eject the sheet transported from the transport roller 211*a* to the ejecting aperture 109, and in a reverse transport direction to draw back a sheet ejected partway from the ejecting aperture 109. A sheet receiving member 220 can be arranged on the upper side of the printer 100*a*. The sheet ejected from the ejecting aperture 109 can be stored on the sheet receiving member 220. The ejecting rollers 212*a* and 212*b* can serve as an ejecting transport member.

Next, a composition for two-sided printing (e.g., image-forming on two sides of a medium, such as paper) will be described. An ejecting sensor lever 231 and an ejecting sensor 232 serving as a detecting member can be arranged downstream of the fusing roller 209 and the pushing roller 210 in the sheet transport direction to detect the passing of a sheet. The ejecting sensor lever 231 can be or include a swing lever, and can be repositioned with respect to (e.g., fall over onto) the inside of the transport path 110 by contact with a sheet that passes through the fusing roller 209 and the pushing roller 210. The ejecting sensor 232 can be or include, for example, a photo coupler, and detect optically whether the ejecting sensor lever 231 is in a lying position or a standing position. If the ejecting sensor lever 231 contacts the sheet, and is in the lying position, the ejecting sensor 232 can output an ON signal. Also, if the ejecting sensor lever 231 does not contact the sheet, and is in the standing position, the ejecting sensor 232 can output an OFF signal.

As will be described with reference to FIG. 4, a printing controller 800 of the printer 100*a* can order (e.g., issue or generate one or more commands to cause) transport of a sheet toward a returning transport unit 108 (described later) by the reverse of the rotation of the ejecting roller 212*a* at a time corresponding to a front edge of the sheet passing through the transport rollers 211*a* and 211*b*, based on the sensing signals of the ejecting sensor lever 231 and the ejecting sensor 232. Therefore, a reverse transport path 112 that guides a sheet transported toward the returning transport unit 108 by the reverse of the rotation of the ejecting roller 212*a* can be arranged in the ejecting unit 107.

The returning transport unit 108 can be arranged on an underside of the image drum unit 104 and the fusing unit 106, and on the upper side of the supplying cassette 101. Also, the returning transport unit 108 can include a returning transport path 111. A sheet transported from the reverse transport path 112 to the transport unit 102 can pass through the returning transport path 111 arranged under sides of the fusing unit 106 and the image drum unit 104. Also, the returning transport path 111 can be arranged adjacent to the registration roller 205*a* and the pressure roller 205*b*, and merge with the transport path 110.

Reverse transport rollers 213*a* and 214*a* can be arranged along the returning transport path 111. The transport rollers 213*a* and 214*a* can rotate by the driving of the main motor 881. Also, reverse transport rollers 213*b* and 214*b* can be arranged opposite the reverse transport rollers 213*a* and 214*a* so as to sandwich a sheet with the reverse transport rollers 213*a* and 214*a* during carrying of the sheet in the returning transport path 111.

Figure 2:
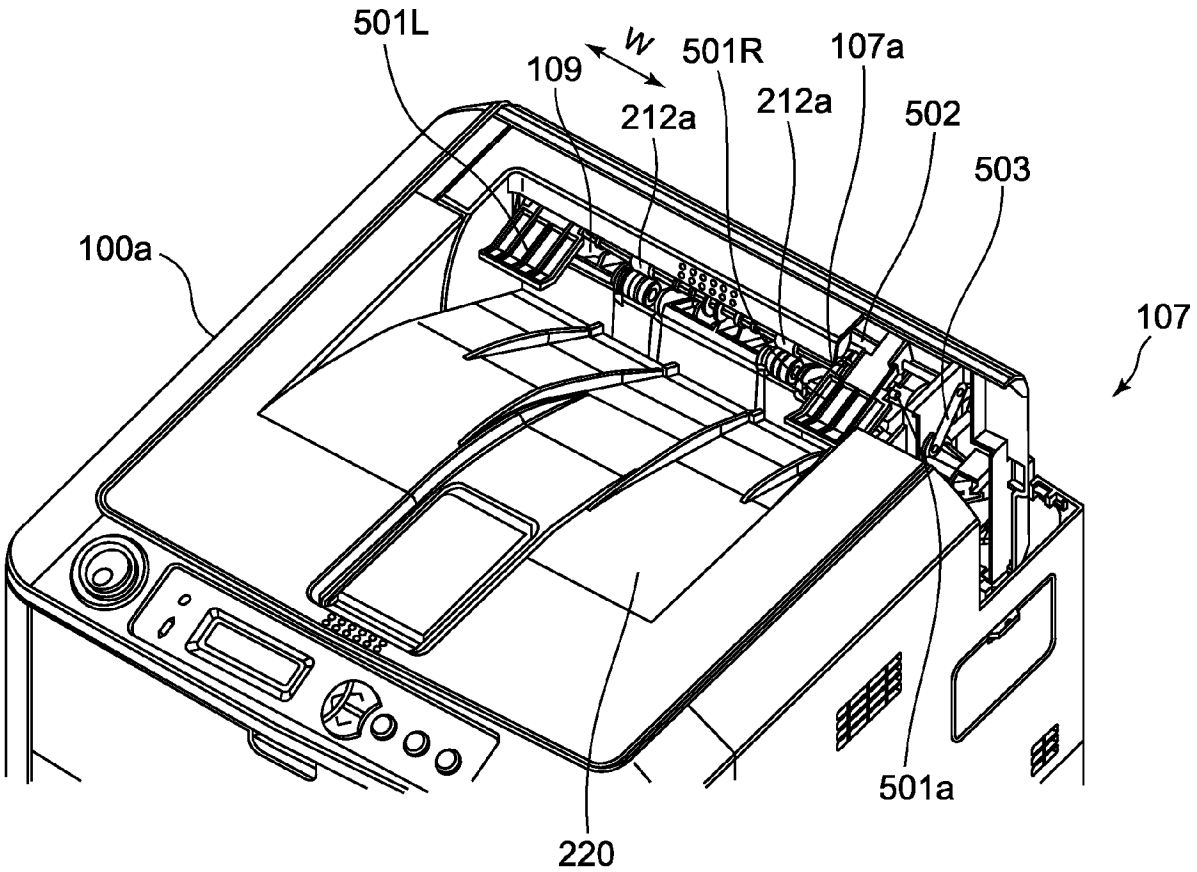
FIG. 2 is a perspective view illustrating a part of the printer that includes a guide member according to the first embodiment.

FIG. 2 is a perspective view illustrating a part of the printer 100*a* that includes guide members 501L and 501R according to the first embodiment. The guide members 501L and 501R serving as a sheet pushing member can be arranged adjacent to the ejecting aperture 109 so as to be symmetrically located with respect to each other about a center in a width direction of the transport path 110. In the discussion of this embodiment, the A4 size (width is 210 mm) and the letter size (width is 216 mm) that are used very often are assumed as illustrative examples of sizes of a sheet. However, sizes of the sheet are not limited to these sizes.

The guide members 501L and 501R can be supported swingably by a shaft 501*a* fixed to a frame of the ejecting unit 107. The axis direction of the shaft 501*a* can be parallel to the width direction of the transport path 110, e.g., the width direction of the sheet (shown by W). Also, the guide members 501L and 501R can extend from the shaft 501*a* toward the sheet receiving member 220. Also, tops of the guide members 501L and 501R can be inflective.

The guide members 501L and 501R can be formed from or include a rigid plastic, such as POM (polyacetal). A shaft 502 formed from or including, e.g., a metal, that is parallel to the shaft 501*a* can be fixed on the guide members 501L and 501R opposite the shaft 501*a* on a top side (the side of the sheet receiving member 220). One side of the shaft 502 can be fixed to a link member 513 that switches swing angles of the guide members 501L and 501R. Since the guide members 501L and 501R can include the same composition, the guide members 501L and 501R will hereinafter be described as guide members 501 unless there is a need to distinguish the guide member 501L from the guide member 501R.

Figure 3:
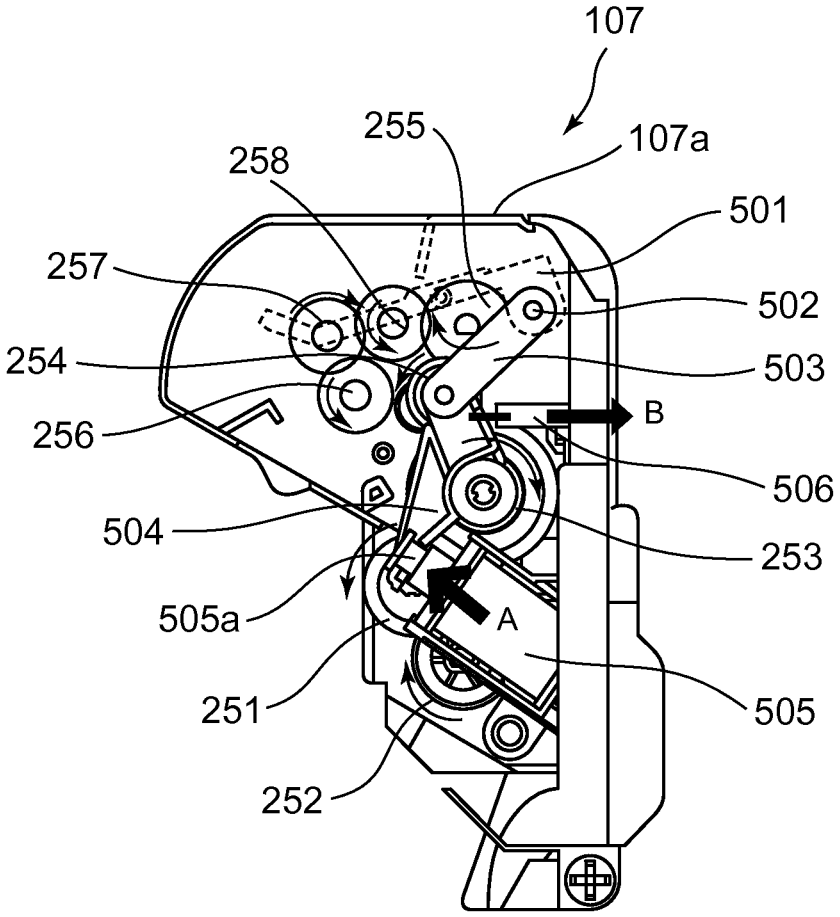
FIG. 3 illustrates a driving system of an ejecting unit according to the first embodiment.

FIG. 3 illustrates a driving system of an ejecting unit 107 according to the first embodiment. The ejecting unit 107 can include gears 251, 252, 253, 255, 256, 257, and 258, and a planetary gear 254 that are components of a gear line serving as a driving force transmission mechanism that transfers the driving force of the main motor 881. The gears can be supported rotatably by a frame 107*a*. The driving force of the main motor 881 can be transferred to the gear 251. The gear 251 can engage the gear 252 arranged on an underside thereof, and engage the gear 253 arranged on an upper side thereof. The gear 252 can connect to the transport roller 211*a*. Also, the gear 253 can engage the planetary gear 254.

The planetary gear 254 can be fixed to one end of a link arm 504 serving as switching member that swings on a coaxial shaft with respect to the rotational axis of the gear 253. The other end of the link shaft 504 can be fixed to a plunger 505*a* of a solenoid 505 serving as an actuator. The link arm 504 can swing due to the projecting and retracting of the plunger 505*a* with respect to the solenoid 505. The planetary gear 254 can move between one engagement position with the gear 255 connected with the ejecting roller 212*a* and the other engagement position with the gear 256. Also, the one end of the link arm 504 can connect to the link member 503.

The gear 255 can engage the gear 258, the gear 258 can engage the gear 257, and the gear 257 can engage the gear 256. E.g., as shown in FIG. 3, if the planetary gear 254 engages the gear 256, the rotation of the planetary gear 254 can be transferred to the gears 256, 257, 258, and 255 in that order.

As described above, the gear 252 can connect to the transport roller 211*a*, and the gear 255 can connect to the ejecting roller 212*a*. The transport roller 211*a* can rotate in a defined direction by transferring the rotation of the main motor 881 through the gear 252. The rotational direction of the ejecting roller 212*a* can be switched depending on whether the planetary gear 254 engages the gear 254 or the gear 256.

The link arm 504 can be moved by a spring 506 in a predetermined direction so that the planetary gear 254 engages the gear 255 as shown by the arrow B. When the solenoid 505 is not supplied power (e.g., is in an OFF state), the plunger 505*a* can be disposed in a projecting position, and the planetary gear can engage the gear 255 by a biasing force of the spring 506.

When the solenoid 505 is supplied power (e.g., is in an ON state), the plunger 505*a* can move from the projecting position to a retreat position, the link arm 504 and the link member 503 can swing with respect to the biasing force of the spring 506, and the planetary gear 254 can leave the gear 255, and engage the gear 256. In this way, the rotational direction of the ejecting roller 212*a* can be switched by the behavior of ON and OFF of the solenoid 505.

The other end of the link arm 504 can be connected with the shaft 502. When the solenoid 505 is not supplied power, the link member 503 can push the shaft 502, and the guide members 501 can rotate in a counter-clockwise fashion (e.g., move toward the sheet receiving member 220) on the shaft 501*a*. Also, when the solenoid 505 is supplied power, the link member 503 can pull down the shaft 502, and the guide members 501 can rotate in a clockwise fashion, e.g., move toward a direction of leaving (e.g., move away from) the receiving member 220 on the shaft 501*a*. In this way, the position of the guide members 501 can be switched by the ON and OFF behavior of the solenoid 505. E.g., the plunger 505*a* can move by the ON and OFF behavior of the solenoid 505. Also, the guide members 501 can be moved by a driving transferring member that includes the link arm 504, the link member 503, and the shaft 502 that transfer the driving force with respect to the ON and OFF behavior of the solenoid 505. A switching unit that switches the position of the guide members 501 can include the solenoid 505 serving as a driving member, the link arm 504, the link member 503, and the shaft 502. In this embodiment, the switching unit can switch the position of the guide members 501 and the rotational direction of the ejecting rollers 212*a* and the 212*b*.

Figure 4:
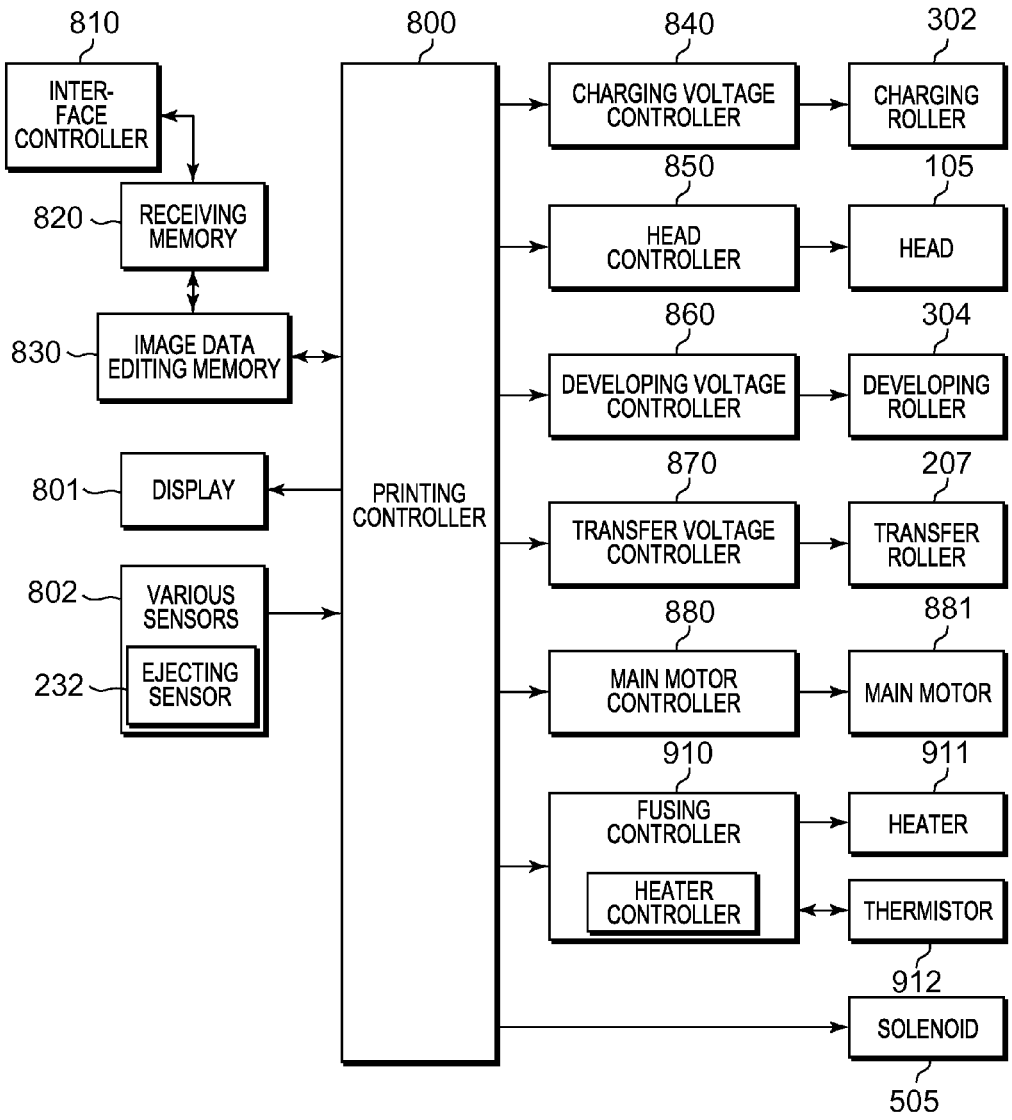
FIG. 4 is a block diagram illustrating a control system of the printer according to the first embodiment.

FIG. 4 is a block diagram illustrating a control system of the printer 100*a* according to the first embodiment. The printer 100*a* can include a printing controller 800 that has a micro processor, a Read Only Memory (ROM), a Random Access Memory (RAM), an input-output port, and a timer. The printing controller 800 can receive a control command and printing data from a higher-level apparatus, and sequentially control the printer 100*a* regarding the printing behavior of the printer 100*a*.

Also, the printer 100*a* can include an interface controller 810, a receiving memory 820, an image data editing memory 830, a display 801, and various sensors 802.

The interface controller 810 can send printer information to the higher-level apparatus, such as a personal computer, analyze a command input from the higher-level apparatus, and handle data received from the higher-level apparatus. The receiving memory 820 can store color data received from the higher-level apparatus based on the order (e.g., command) of the interface controller 810. The image data editing memory 830 can receive printing data that is input from the higher-level apparatus through the interface controller 810 and the printing data can be stored temporarily in the receiving memory 820. Also, the image data editing memory 830 can edit the printing data as image data, and store the image data. The display 801 can include, for example, an LCD (Liquid Crystal Display), and can indicate the state of the printer 100*a*. The various sensors 802 can detect the transport position of a sheet, and the humidity and temperature inside of the printer 100*a*. The ejecting sensor 232 can be included in the various sensors 802. The outputs of the various sensors can be sent to the printing controller 800, and be indicated on the display 801.

Also, the printer 100*a* can include a charging voltage controller 840, a head controller 850, a developing voltage controller 860, and a transfer voltage controller 870. The charging voltage controller 840 can apply the charging voltage to the charging roller 302 based on an order (e.g., command) of the printing controller 800 so as to charge the surface of the image drum 301. The head controller 850 can activate the LED head 105 in a predetermined timing based on the image data stored in the image editing memory 830 so as to expose the surface of the image drum 301 to light. The developing voltage controller 860 can apply the developing voltage to the developing roller 304 based on an order of the printing controller 800 so as to attach a toner to the electrostatic latent image formed onto the surface of the image drum 301. The transfer voltage controller 870 can apply the transfer voltage to a transfer roller 207 (see, also, FIG. 1) based on the printing controller 800 so as to transfer a toner image formed on the surface of the image drum 301 to a sheet.

Also, the printer 100*a* can include a main motor controller 880, and a fusing controller 910. The main motor controller 880 can control the driving of the main motor 881. As described above, the image drum 301 (and the developing roller 303, the supplying roller 305, and the transfer roller 207 that engage the image drum 301), the pick-up roller 202, the supplying roller 201, the transport roller 204*a*, the registration roller 205*a*, the fusing roller 209, the transport roller 211*a*, the ejecting roller 212*a*, the reverse transport rollers 213*a* and 214*a* can rotate by the driving of the main motor 881. E.g., the main motor 881 can be a driving force of the rotation of the respective rollers that transport a sheet in the image drum unit 104, the supplying unit 101, the transport unit 102, the fusing unit 106, the ejecting unit 107, and the returning transport unit 108.

The fusing controller 910 can apply a voltage to a heater 911 arranged inside of the fusing roller, based on a detected temperature of a thermistor 912 that detects the temperature of the fusing unit 106, based on an order of the printing controller 800.

When one-sided printing is executed, the printing controller 800 can maintain a stoppage of power supply to the solenoid 505. Also, when two-sided printing is executed, the printing controller 800 can supply power to the solenoid 505 depending on positional information of a sheet received from the ejecting sensor 232.

Figure 5A:
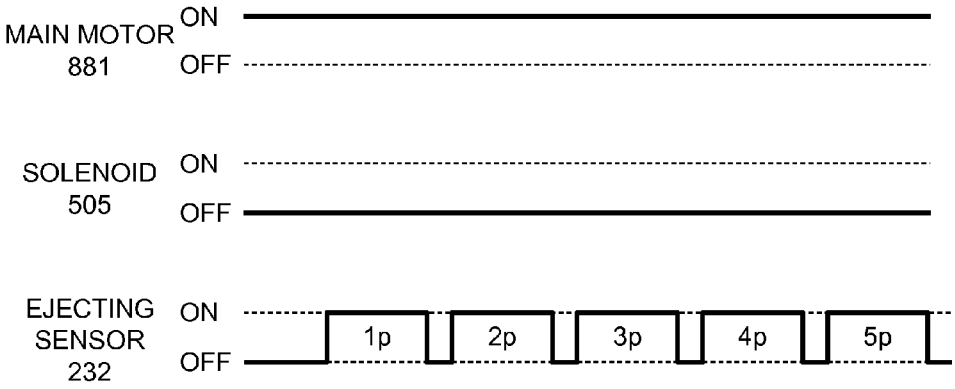
FIG. 5A illustrates a time chart of a one-sided printing behavior according to the first embodiment.
Figure 5B:
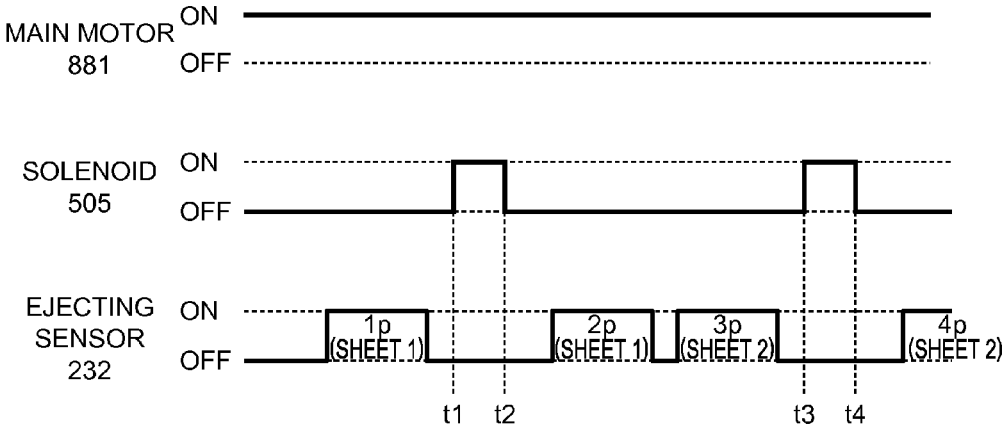
FIG. 5B illustrates a time chart of a two-sided printing behavior according to the first embodiment.
Figure 6A:
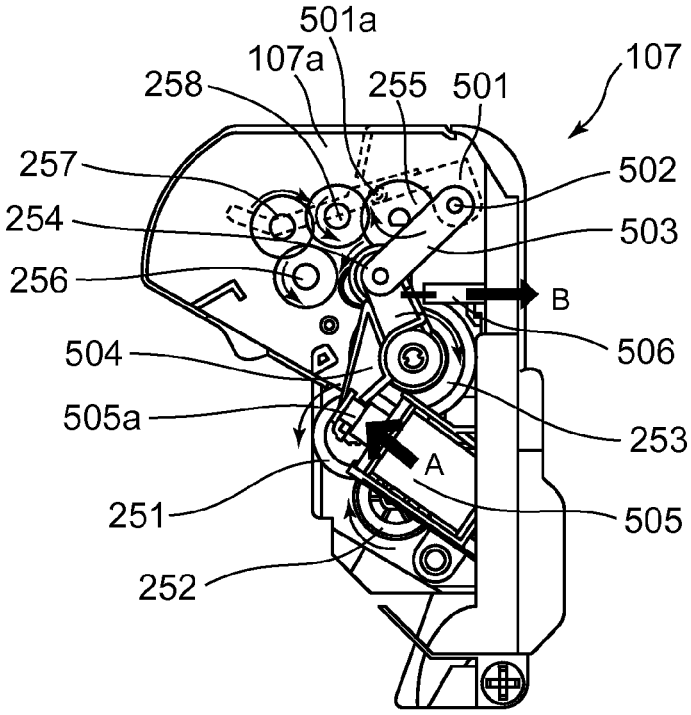
FIG. 6A is a view illustrating the ejecting unit during an ejection of a sheet according to the first embodiment.
Figure 6B:
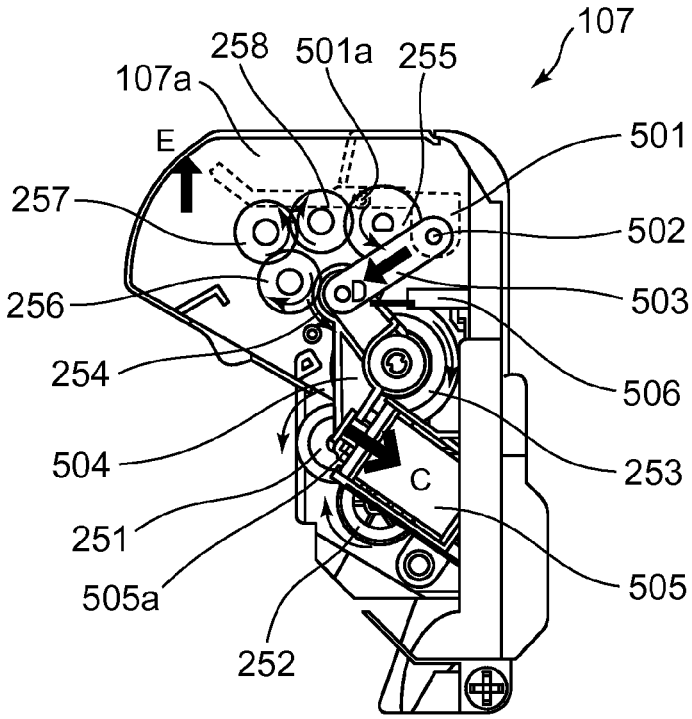
FIG. 6B is a view illustrating the ejecting unit during a reverse transport of the sheet according to the first embodiment.
Figure 7A:
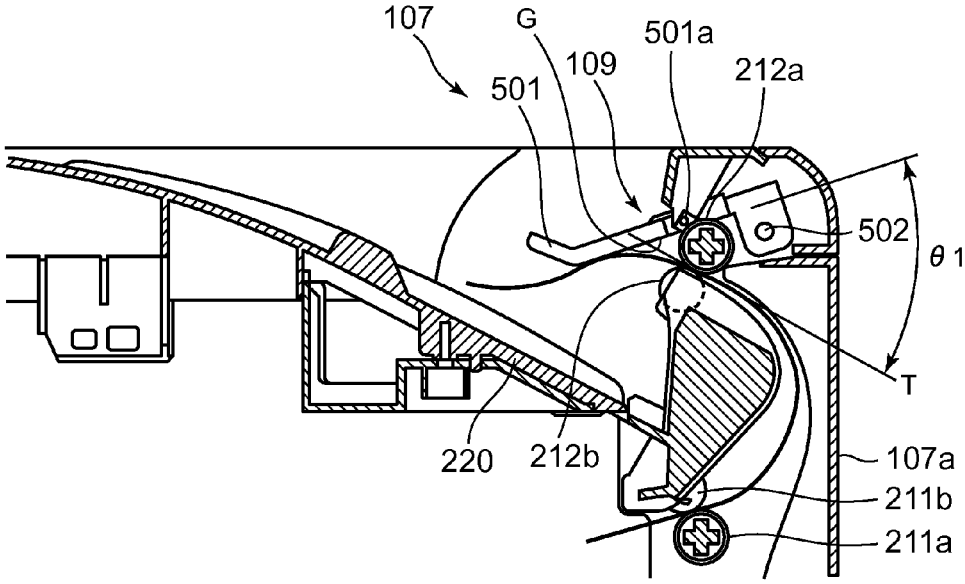
FIG. 7A is a view illustrating the guide member during the ejection of the sheet according to the first embodiment.
Figure 7B:
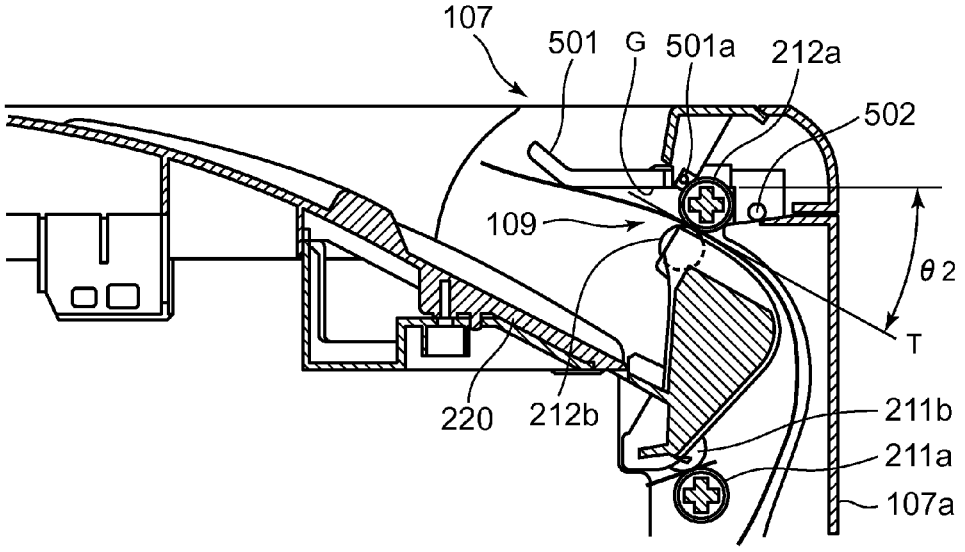
FIG. 7B is a view illustrating the guide member during the reverse transport of the sheet according to the first embodiment.

Next, a printing behavior will be described. FIG. 5A illustrates a time chart of one-sided printing behavior according to the first embodiment. FIG. 5B illustrates a time chart of two-sided printing behavior according to the first embodiment. FIG. 6A is a view illustrating the ejecting unit 107 during an ejection of a sheet according to the first embodiment. FIG. 6B is a view illustrating the ejecting unit 107 during a reverse transport of a sheet according to the first embodiment. FIG. 7A is a view illustrating the guide member 501 during the ejection of a sheet according to the first embodiment. FIG. 7B is a view illustrating the guide member 501 during the reverse transport of a sheet according to the first embodiment.

The printing controller 800 can receive a control command and printing data sent from the higher-level apparatus through the interface controller 810. As shown in FIG. 5A, if the printing controller 800 receives printing data corresponding to one-sided printing, the printing controller 800 can maintain a stoppage of power supply to the solenoid 505 even though the detecting signal of the ejecting sensor 232 includes an ON signal or OFF signal.

While the solenoid 505 is supplied power, the link arm 504 can be in a predetermined position due to the biasing force of the spring 506 so that the planetary gear 254 engages the gear 255. Therefore, as shown in FIG. 6A, the rotation of the gear 251 can be transferred to the gears 253, 254, 255, 258, 257, and 256 in that order, and the gears can respectively rotate in the arrow direction. The transport roller 212*a* connected with the gear 255 can rotate in a forward direction (first direction) in which a sheet is ejected from the ejecting aperture 109.

Since the link member 503 can push the shaft 502, the guide members 501 can move to the underside thereof on the shaft 501*a*. After the guide members 501 have moved, as shown in FIG. 7A, the guide members 501 can be in a first predetermined position (first position) so as to guide a sheet ejected from the ejecting aperture 109 to the sheet receiving member 200. An angle θ1 can be the angle between a guide face G of the guide member 501 that can contact the sheet and a tangent line T at a contacting part of the transport roller 212*a* and the ejecting roller 212*b* (e.g., a tangent line T parallel to the transport direction during the sheet passing through the contacting part). The angle θ1 can be set so that the sheet guided to the guide face G is stored on the sheet receiving member. For example, in this embodiment, the angle θ1 can be set at substantially 48°.

In this state, the printing controller 800 can make the pick-up roller 202 and the supplying roller 201 rotate so as to separate and supply individual sheets in the supplying cassette to the transport path 110. Also, the printing controller 800 can make the transport roller 204*a* and the registration roller 205*a* rotate so as to transport a sheet into the image drum unit 104 along the transport path 110. In the image drum unit 104, the charging roller 302 can uniformly charge the surface of the image drum 301, and the LED head can form an electrostatic latent image on the surface of the image drum 301. Then the developing roller 304 can develop the electrostatic latent image by the toner. The toner image on the surface of the image drum 301 can be transferred onto the sheet by the transfer roller 207.

The sheet onto which the toner image has been transferred in the image drum unit 104 can be transported to the fusing unit 106 by the rotation of the transfer roller 207. In the fusing unit 106, the fusing roller 209 and the pushing roller 210 can fuse the toner image onto the sheet by applying a heat and pressure. The sheet onto which the toner image has been fused can be transported to the transport rollers 211*a* and 211*b* by the rotation of the fusing roller 209. The transport roller 211*a* can transport the sheet to the ejecting rollers 212*a* and 212*b*. Since the solenoid 505 can be controlled so as to not be supplied power, the ejecting roller 212*a* can rotate in the forward direction, and eject the sheet from the ejecting aperture 109. The ejected sheet can be stored on the sheet receiving member 220 by guiding of the guide members 501. As noted previously, the foregoing operations can be included in one-sided printing resulting in a sheet having an image formed on one side.

In case of two-sided printing, as with one-sided printing, a first sheet can be transported from the supplying cassette 101 to the image drum unit 104. Then the toner image can be formed on the surface of the first sheet (first page) by the image drum unit 104, and the toner image can be fused onto the sheet by the fusing unit 106. The sheet on which the toner image is fused can be transported by the transport roller 211*a*, and be transported in the forward direction by the ejecting roller 212*a*. Then as shown in FIG. 7A, ejection of the sheet can be begun from the ejecting aperture 109.

Here, if the ejecting sensor 232 detects a passing of the front edge of the sheet, the printing controller 800 can start to supply power to the solenoid 505 at a predetermined time corresponding to the front edge of the sheet passing through the transport roller 211*a* (time t1 as shown in FIG. 5B). As shown in FIG. 6B, the plunger 505 can move to the retreat position shown by the C arrow with respect to the biasing force of the spring 506. The link arm 504 can move in the D direction, and the planetary gear 254 can leave the gear 255, and engage the gear 256, due to the movement of the plunger 505*a*.

Since the planetary gear 254 engages the gear 256, the rotation of the main motor 881 can be transferred to the gears 251, 253, 254, 256, 257, 258, and 255 in that order. Therefore, the rotational directions of the gears 255, 256, 257, and 258 can be opposite to the rotational directions of the gears shown in FIG. 6A. As a result, the transport roller 212*a* can reverse its rotational direction, and rotate in a second predetermined direction (second direction) to transport the sheet toward the returning transport unit 108. E.g., the sheet ejected partway from the ejecting aperture 109 can be drawn back into the image forming apparatus 100, and be transported toward the returning transport unit 108.

Also, since the link member 503 can pull down the shaft 502 by the rotation of the link arm 504 in the D direction, the guide members 501 can be pushed in the E direction on the shaft 501*a*. As a result, as shown in FIG. 7B, the guide members 501 can move to a predetermined position so as to reduce a friction with respect to a sheet that passes through the contacting part between the transport roller 212*a* and the ejecting roller 212*b*, e.g., move to a second predetermined position (second position) so as to reduce a pushing force of the guide members 501 applied to the sheet. As a result, it is possible to reduce a pushing force of the guide members 501 applied to a reverse-transported sheet.

An angle θ2 can be the angle between the guide face G and the tangent line T during the sheet moving to the returning transport unit 108. For example, in this embodiment, the angle θ2 can be set at substantially 30°, and θ1<θ2.

The sheet can be transported to the returning transport unit 108 through the reverse transport path 112 by the reversal of the ejecting roller 212*a*. The printing controller 800 can stop supplying power to the solenoid 505 at a predetermined time (t2 as shown in FIG. 5B) that the sheet is gone from the ejecting unit 107. By stopping supplying power to the solenoid 505, as shown in FIG. 6A, the plunger 505*a* can project from the retreat position due to the biasing force of the spring 506, the link arm 504 can move in the opposite direction with respect to the arrow D (see FIG. 6B), and the planetary gear 254 can engage the gear 255. Therefore, the rotational direction of the ejecting roller 212*a* can return to the forward direction so that the sheet is ejected from the ejecting aperture 109, and the guide members 501 can return to the position in shown FIG. 7A.

The sheet transported into the returning transport unit 108 can be transported to the returning transport path 111 by the reverse transport rollers 213*a* and 214*a*, and can be transported to the image drum unit 104 by the registration roller 205*a* and the pressure roller 205*b*. During transporting, the surface of the sheet (page one) on which the image is already formed can face toward the underside of the image forming apparatus 100, and the reverse face of the sheet (page two) on which the image has not yet formed can face toward the upper side thereof. Then in the image drum unit 104, the toner image can be formed on the reverse face of the sheet (page two), and the toner image can be fused onto the sheet at the fusing unit 106.

The sheet on which the toner image is fused onto page two can be transported to the ejecting aperture 109 by the transport rollers 211*a*, 211*b*, and the ejecting rollers 212*a*, 212*b*, and can be ejected from the ejecting aperture 109. During the ejection of the sheet, since the guide members 501 return to the position shown FIG. 7A, the sheet can be guided by the guide members 501 as with the one-sided printing, and can be stored on the sheet receiving member 220. As noted previously, the foregoing operations can be included in two-sided printing resulting in a sheet having an image formed on two sides.

Two-sided printing of additional sheets, for example, image forming on the surface (third page) and the reverse face (fourth page) of a second sheet (corresponding to times t3 and t4 as shown in FIG. 5B), and image forming on the surface (fifth page) and the reverse face (sixth page) of a third sheet, and so on, up to a desired number of sheets, can also be executed.

Figure 8A:
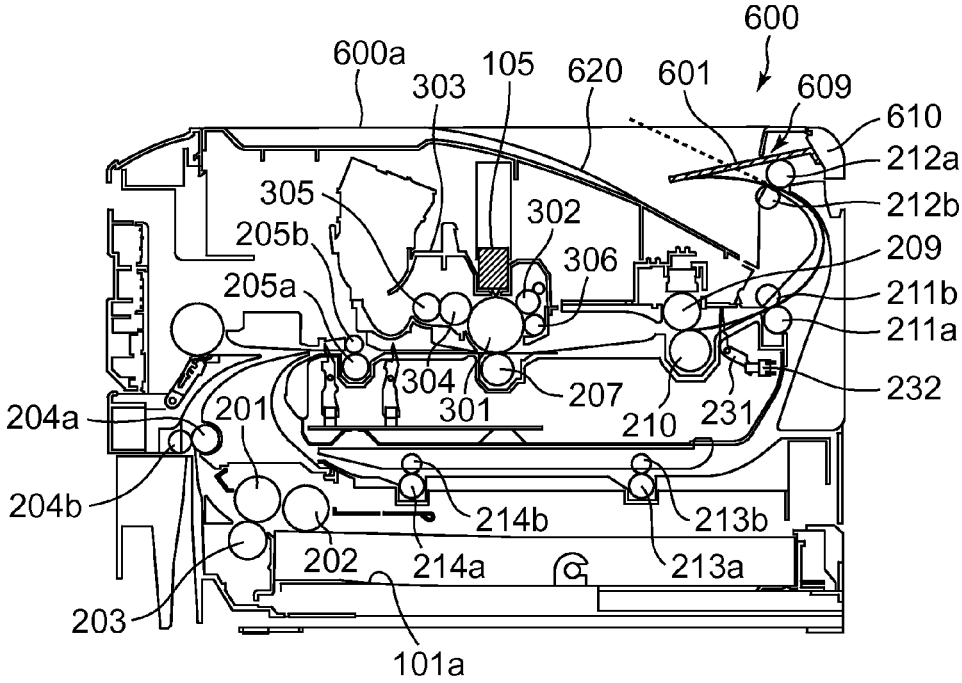
FIG. 8A is a view illustrating a guide member of a comparative example ejecting the sheet.
Figure 8B:
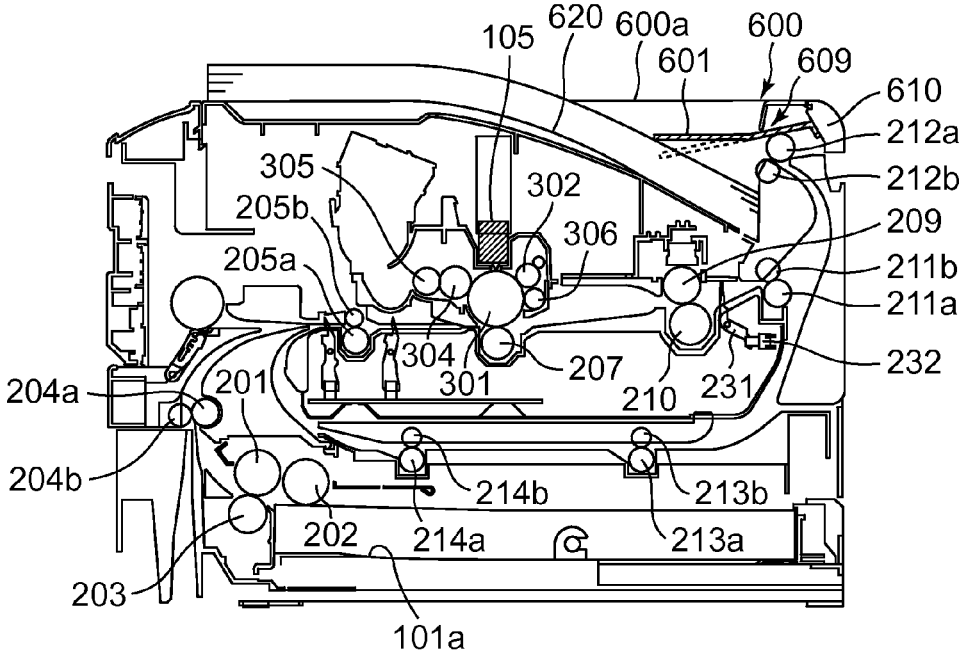
FIG. 8B is a view illustrating a guide member of a comparative example during the reverse transport of the sheet.

Next, the function effect of the first embodiment will be described by comparing to a comparative example. FIG. 8A and FIG. 8B are views illustrating a guide member 601 of a printer 600 of the comparative example while the sheet is ejected through the guide member 601. In FIG. 8A, a guide member 601 is a long material formed by a film or board made of plastic, and is arranged at two locations in the width direction of the sheet. One side of the guide member 601 in the length direction of the sheet is fixed to a frame 610 of an ejecting unit. Also, the other side of the guide member 601 projects toward the area where the sheet is ejected from an ejecting aperture 609.

The guide member 601 contacts the sheet ejected from the ejecting aperture 609, and guides the sheet to a sheet receiving member 620. As a result, even if the sheet is ejected from the ejecting aperture 609 in the state of curling by a heat or dehumidification in a fusing unit, the sheet may be stored on the sheet receiving member 620, as shown in FIG. 8B.

However, in this comparative example, the guide member usually holds the sheet. Therefore, if the respective degrees of curling of the sheet or the respective degrees of contacting the guide member 601 at the right and left of the sheet are different from each other, the respective frictions which the sheet receives from the guide member 601 (transport friction) at the sides thereof are different from each other. Therefore, transport obliquely of the sheet might occur, and a gap of a printing position might occur between the surface and the reverse face of the sheet.

In contrast to this, in the first embodiment, as shown in FIG. 7B, the guide members 501 can move to the predetermined position so as to reduce the pushing force on the sheet, while the returning transport of the sheet is executed in the two-sided printing. Therefore, it is possible to prevent the transport obliquely as in the comparative example, and to prevent the gap of the printing position between the surface and the reverse face of the sheet.

Also, the switching of the rotational direction of the ejecting roller 212*a*, and the switching of the position of the guide members 501 can be executed by a mutual actuator (the solenoid 505). Therefore, it is possible to prevent the transport obliquely by a light composition, and to reduce production cost.

In this embodiment, the guide members 501 can move to the retreat position so as to reduce the pushing force to the sheet during the reverse transport of the sheet. Additionally, the guide members 501 can move so as to leave the sheet, providing a clearance between the guide members 501 and the sheet. As a result, the sheet can be transported without a pushing force from the guide members 501 during the reverse transport of the sheet.

Also, not only the rigid plastic but also a plastic film can be used as at least part of the guide member 501. Since the plastic film has elasticity and flexibility, if the plastic film is used to form at least part of the guide member 501 instead of the rigid plastic, it can reduce the pushing force to the sheet.

Also, not only the solenoid but also a combination of a motor with a cam mechanism or a link mechanism can be used as the actuator that switches the position of the guide member 501. When the motor is used as the actuator, it is possible to prepare plural retreat positions of the guide member 501.

Also, not only two members but also one member or more than two members can be used as the guide member 501. If, for example, two guide members 501 are used, the two guide members 501 can be arranged symmetrically in the width direction of the sheet, to guide the sheet by contacting the left and right sides evenly.

Second Embodiment

In a second embodiment, the printer 100*a* serving as the image forming apparatus 100 can include features that are also well-adapted to handle curling of a printing medium that may occur due to a storage or usage environment.

Figure 9A:
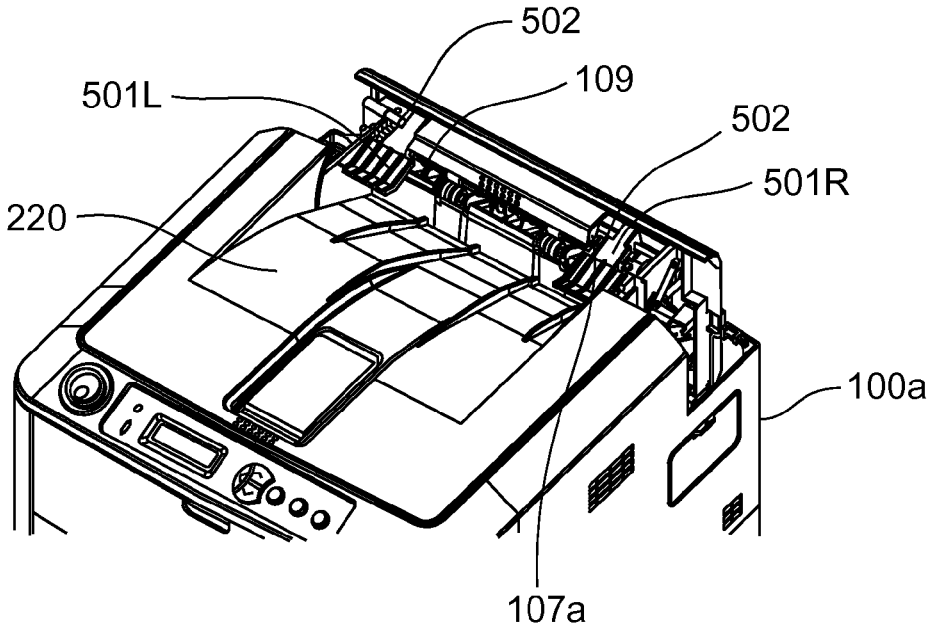
FIG. 9A is a perspective view illustrating a part of a printer serving as the image forming apparatus that includes a guide member according to a second embodiment.
Figure 9B:
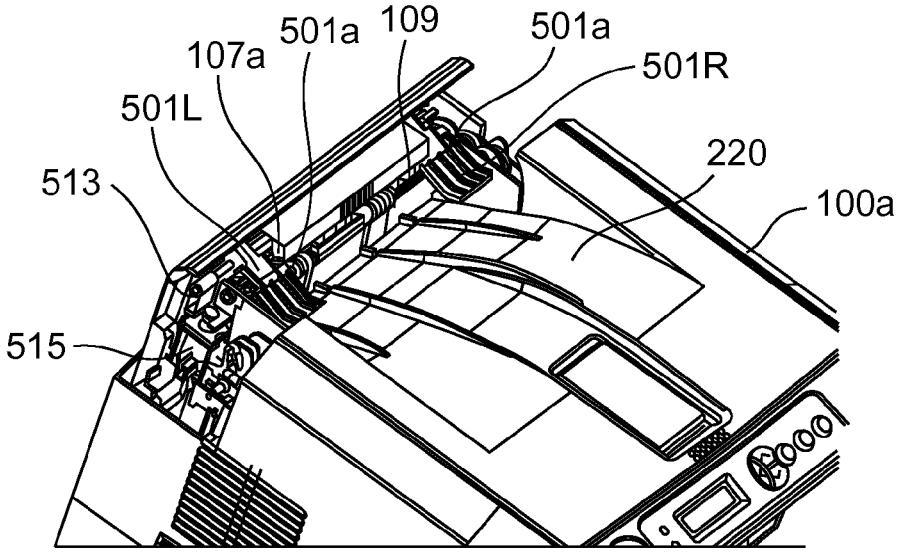
FIG. 9B is a perspective view illustrating a part of the printer that includes a guide member according to the second embodiment.

FIGS. 9A and 9B are perspective views illustrating a part of a printer 100*a* that includes the guide member 501L and 501R according to the second embodiment. In the second embodiment, elements that are the same as corresponding elements of the first embodiment are given the same reference characters.

The compositions and alignments of the guide members 501L and 501R in the second embodiment can be the same of the first embodiment. The shaft 502 formed from or includes a metal that is parallel to the shaft 501*a* can be fixed on the guide members 501L and 501R. One side of the shaft 502 can be fixed to the link member 513 that can switch the swing angles of the guide members 501L and 501R. As with the first embodiment, the guide members 501L and 501R will be described as the guide members 501 except unless there is a need to distinguish the guide member 501L from the guide member 501R.

In the first embodiment, the switching of the rotational direction of the ejecting roller 212*a* and the switching of the position of the guide member 501 can be executed by the mutual solenoid 505. However, in the second embodiment, the switching of the rotational direction of the ejecting roller 212*a* and the switching of the position of the guide member 501 can be executed by the solenoid 505 and a solenoid 515 (actuator). E.g., the plunger 505*a* can move based on an ON and OFF behavior of the solenoid 505. Then the link arm 504 can switch the rotational directions of the ejecting roller 212*a* and 212*b* by transferring the driving force with respect to the ON and OFF behavior of the solenoid 505. The solenoid 505 and the link arm 504A can serve as a transport direction switching unit. Also, the plunger 515*a* can move based on the ON and OFF behavior of the solenoid 515. Then the guide members 501 can be moved by the driving transferring member that can include the link member 513, and by the shaft 502 transferring the driving force with respect to the ON and OFF behavior of the solenoid 515. The switching unit that can switch the position of the guide members 501 can include the solenoid 515 serving as the driving member, the link member 513, and the shaft 502.

Figure 10A:
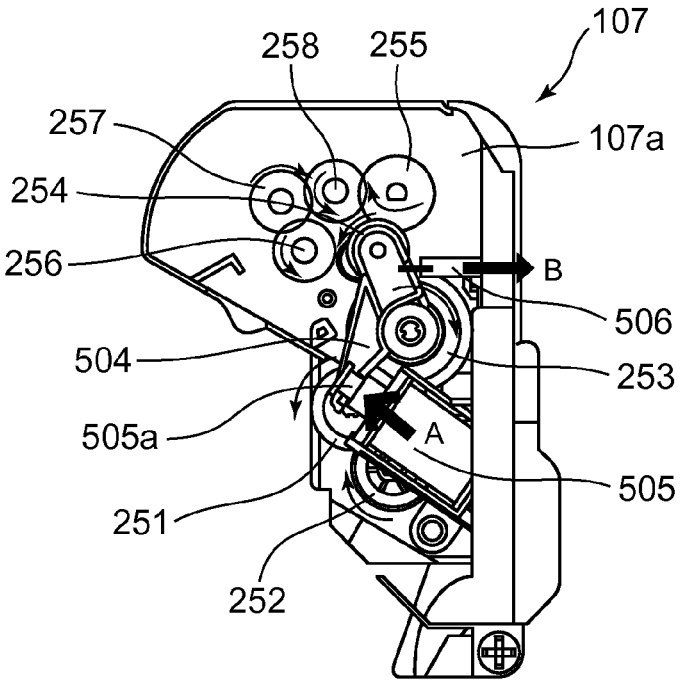
FIG. 10A illustrates an ejecting unit during the ejection of a sheet according to the second embodiment.
Figure 10B:
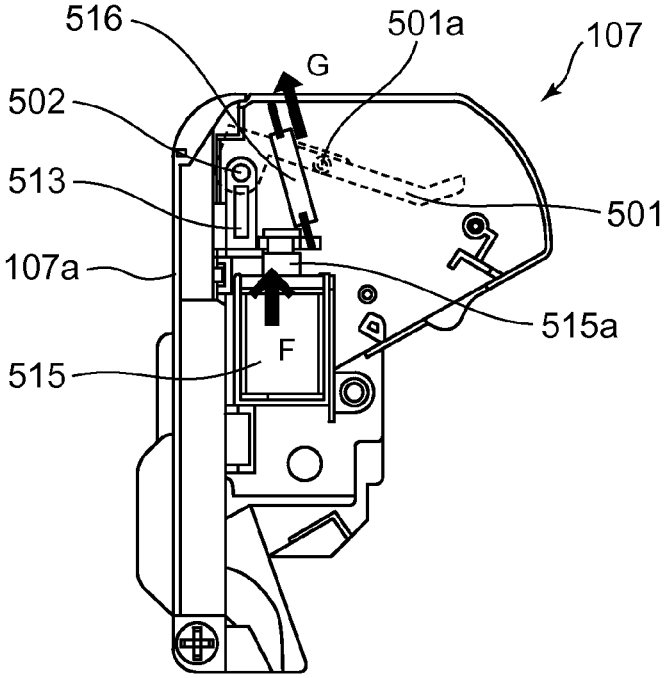
FIG. 10B illustrates the ejecting unit during the ejection of the sheet according to the second embodiment.

FIG. 10A illustrates the driving unit of the ejecting unit 107 during the ejection of a sheet according to the second embodiment. FIG. 10B illustrates the ejecting unit from the opposite side to FIG. 10A during the ejection of the sheet according to the second embodiment. The ejecting unit 107 can include the gears 251, 252, 253,254, 255, 256, 257, and 258 that form at least part of the gear line serving as the driving force transmission mechanism that transfers the driving force of the main motor 881, and the solenoids 505 and 515. The composition of the gear line can be the same as that of the first embodiment. However, the ejecting unit 107 need not, for example, include the link member 503 as shown FIG. 3.

As shown in FIG. 10B, one end of the link member 513 can be connected with the shaft 502 (shown in FIG. 9A), and the other end of the link member 513 can be connected with a plunger 515*a* of the solenoid 515. The solenoid 515 can be fixed to the frame 107*a*, and include the plunger 515*a* that can move between a projecting position shown the arrow F and a retreat position. Also, the plunger 515 can be biased in the F direction by the spring 516 so as to make the link member 513 move in the G direction. As a result, when the solenoid 515 is not supplied power, the plunger 515*a* can move in the F direction. Also, when the solenoid 515 is supplied power, the plunger 515*a* can move from the projecting position to the retreat position.

Figure 11:
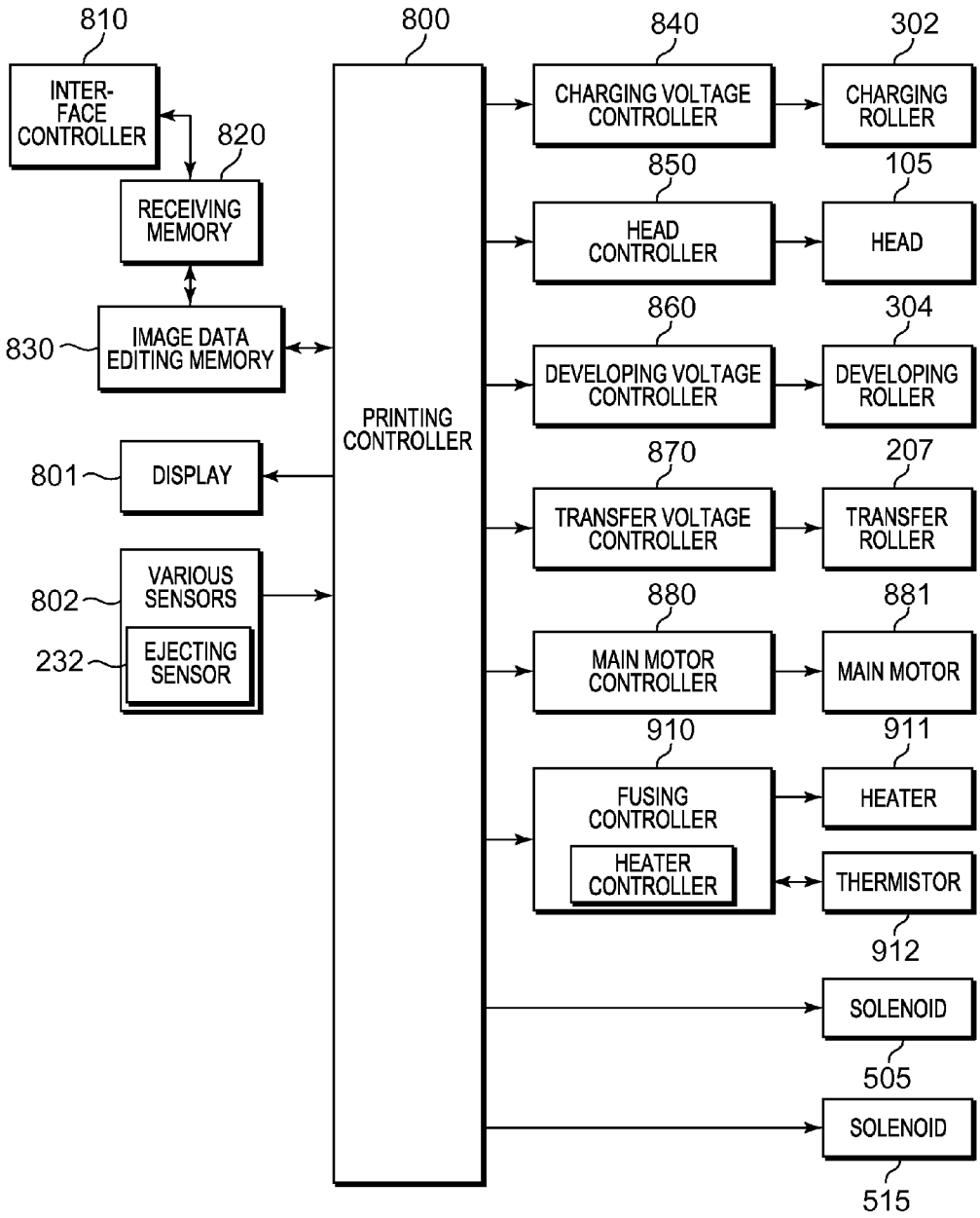
FIG. 11 is a block diagram illustrating a control system of the printer according to the second embodiment.

FIG. 11 is a block diagram illustrating a control system of the printer 600*a* according to the second embodiment. Basically, the control system of the second embodiment can be the same as that of the first embodiment. However, additionally, the printing controller 800 can control the solenoid 515 in addition to the solenoid 505.

In the two-sided printing, the printing controller 800 can supply a power to the solenoids 505 and 515 at a predetermined timing corresponding to a transporting position of a sheet based on a detecting signal of the ejecting sensor 232. E.g., the printing controller 800 can execute control so as to stop supply of power to the solenoids 505 and 515 in one-sided printing.

Figure 12A:
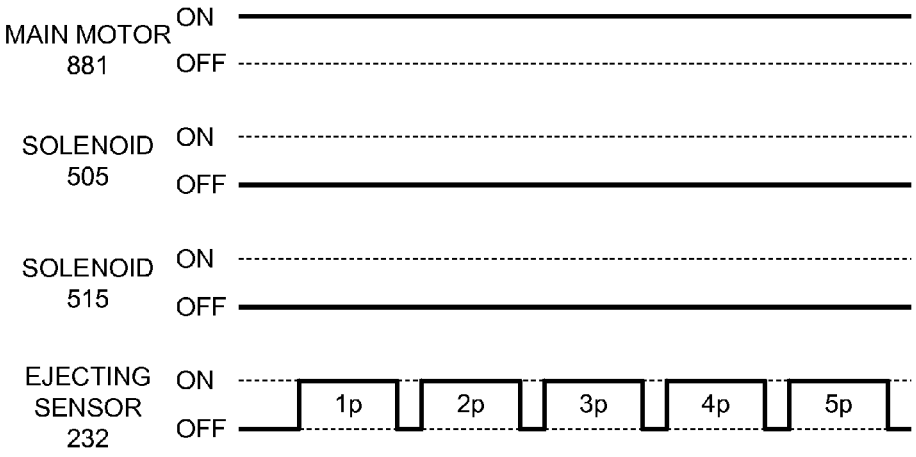
FIG. 12A illustrates a time chart of a one-sided printing behavior according to the second embodiment.
Figure 12B:
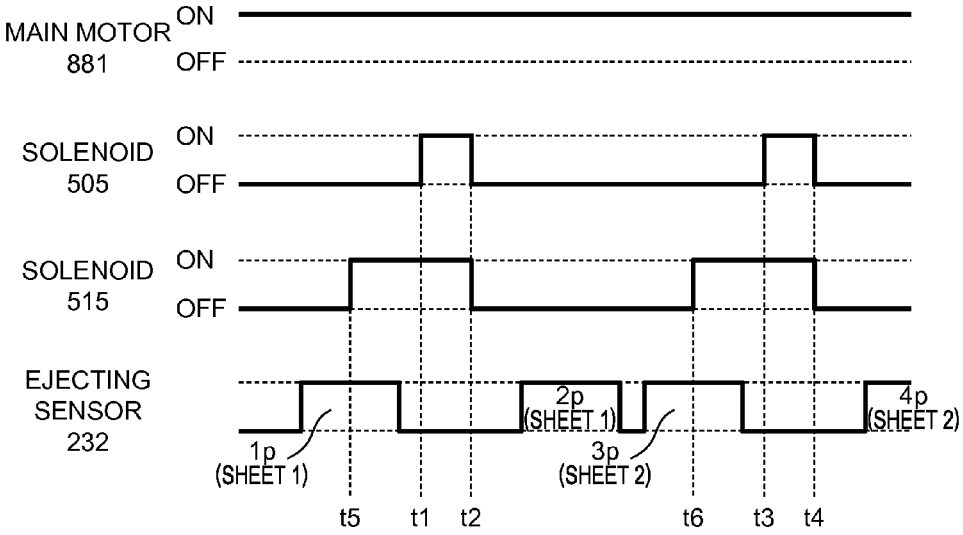
FIG. 12B illustrates a time chart of a two-sided printing behavior according to the second embodiment.
Figure 13A:
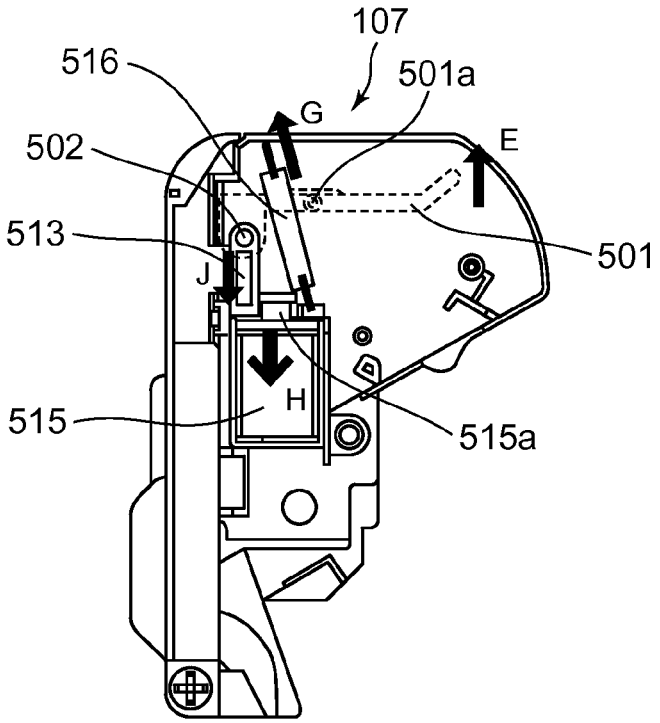
FIG. 13A is a view illustrating the ejecting unit during a reverse transport of the sheet according to the second embodiment.
Figure 13B:
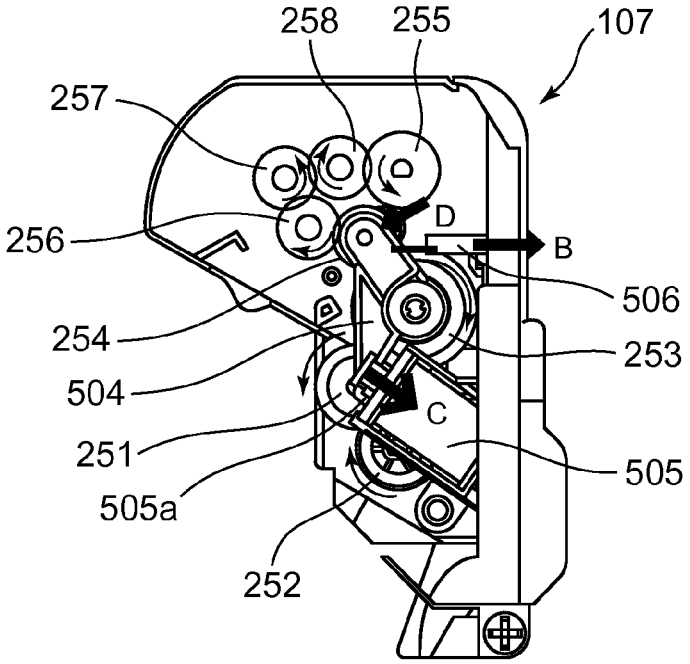
FIG. 13B is another view illustrating the ejecting unit during the reverse transport of the sheet according to the second embodiment.

Next, a behavior of the second embodiment will be described. FIGS. 12A and 12B illustrate a time chart of one-sided printing behavior according to the second embodiment. FIGS. 13A and 13B are views illustrating the ejecting unit 107 during the reverse transport of a sheet according to the second embodiment.

The printing controller 800 can receive the control command and the printing data sent from the higher-level apparatus through the interface controller 810. As shown in FIG. 12A, if the printing controller 800 receives printing data corresponding to one-sided printing, the printing controller 800 can maintain a stoppage of power supply to the solenoids 505 and 515 even though the detecting signal of the ejecting sensor 232 includes an ON signal or OFF signal.

Since the solenoid 505 is not supplied power, the planetary gear 254 can engage the gear 255 as described with reference to the first embodiment. As shown in FIG. 10A, the gear 251 can rotate in the arrow direction by rotational transfer from the main motor 881. As a result, the gears 252, 253, 254, 255, 256, 257, and 258 can rotate respectively in the arrow direction, and the ejecting roller 212*a* can rotate in the forward direction so as to eject a sheet by the rotation of the gear 251. Also, since the solenoid 505 is not supplied power, the guide members 501 can be in the guide position so as to guide the ejected sheet from the ejecting aperture 109 to the sheet receiving member 220. An angle θ1 can be the angle between the guide face G and the tangent line T. As shown in FIG. 7A, the angle θ1 can be set so that the sheet guided to the guide face G is stored on the sheet receiving member.

The one-sided printing can be executed as with the first embodiment, wherein, as previously described, a sheet with the toner image formed thereon can be ejected from the ejecting aperture 109, and be stored on the sheet receiving member 220 by guiding of the guide member 501.

In case of two-sided printing, the image drum unit 104 can transfer the toner image onto the surface of the first sheet (page one), and the fusing unit 106 can fuse the toner image onto the first sheet. Then if the ejecting sensor 232 detects passing of the front edge of the first sheet, the printing controller 800 can supply power to the solenoid at the predetermined time corresponding to the front edge of the first sheet reaching an adjacent part of the guide member 501 (t5; see FIG. 12B). As a result, as shown in FIG. 13A, the plunger 515*a* can move to the retreat position in the H direction against the elastic force of the spring 516, and due to this movement, the link member 513 can move in the J direction. Then due to this movement, the shaft 502 can be pulled down in the J direction, and the guide member 501 can rotate in the E direction on the shaft 501*a*. E.g., the guide member 501 can rotate to a predetermined position so as to reduce the pushing force to the first sheet. Therefore, when the front edge of the sheet is ejected from the ejecting aperture 109, the guide member 501 can already have moved to the predetermined position so as to reduce the pushing force to the first sheet.

Additionally, if the ejecting sensor 232 detects passing of the end edge of the first sheet, the printing controller 800 can supply power to the solenoid 505 at the predetermined time of the end edge passing through the transport roller 211*a* (t1; see FIG. 12B). Since the solenoid 505 can be supplied power, the plunger 505*a* can move to the retreat position in the C direction against an elastic force of the spring 506. Due to this movement, the link arm 504 can move in the D direction, and the planetary gear 254 can leave the gear 255, and engage the gear 256. By this engagement, the rotation of the main motor 881 can be transferred to the gears 257, 258, and 255 through the gears 254 and 256. As a result, the rotational direction of the transport roller 212*a* can reverse. E.g., the first sheet ejected partway from the ejecting aperture 109 can be drawn back into the image forming apparatus, and be transported to the returning transport unit 108.

By the reversal of the ejecting roller 212*a*, the first sheet can be transported to the returning transport unit 108. The printing controller 800 can stop supplying power to the solenoids 505, and 515 at the predetermined time (t2 as shown in FIG. 12B) that the first sheet is gone from the ejecting unit 107. As a result, the rotational direction of the ejecting roller 212*a* can return to the forward direction, and the position of the guide member 501 can return to the position shown in FIG. 10B.

As described with reference to the first embodiment, the first sheet transported to the returning transport unit 108 can be transported to the returning transport path 111, and be transported to the image drum unit 104. During transporting, the surface of the first sheet (page one) on which the image is already formed can face toward the underside of the printer 600*a*, and the reverse face of the sheet (page two) can face toward the upper side thereof. Then in the image drum unit 104, the toner image can be formed on the reverse face of the sheet (page two), and the toner image can be fused onto the first sheet at the fusing unit 106.

The first sheet on which the toner imaged is fused can be transported to the ejecting aperture 109 by the transport rollers 211*a*, 211*b*, and the ejecting rollers 212*a*, 212*b*, and be ejected from the ejecting aperture 109. During the ejection, since the guide members 501 can return to the position shown FIG. 10B, the sheet can be guided by the guide members 501 as with the one-sided printing, and be stored on the sheet receiving member 220.

As with the two-sided printing of the first sheet, two-sided printing of sheets following the first sheet can be executed. For example, if the ejecting sensor 232 detects passing of the front edge of a second sheet, the printing controller 800 can supply power to the solenoid 515 at the predetermined time that the front edge reaches the adjacent part of the guide member 501 (time t1 as shown in FIG. 12B) so that the guide member 501 can move to the predetermined position so as to reduce the pushing force to the second sheet as shown in FIG. 13B. Additionally, if the ejecting sensor 232 detects the end edge of the second sheet, the printing controller 800 can supply power to the solenoid 505 at the predetermined time that the end edge passes through the transport roller 211*a* (time t3 as shown in FIG. 12B) so as to reverse the rotational direction of the ejecting roller 212*a* as shown in FIG. 13B. As a result, the second sheet ejected partway from the ejecting aperture 109 can be drawn back into the printer 600*a*, and be transported to the returning transport unit 108.

Then the image forming of the reverse face (page four) of the second sheet can be executed (where as shown in FIG. 12B, t6, t3 and t4 for the second sheet correspond respectively to t5, t1 and t2 for the first sheet), and the surface (page five) and reverse face (page six) of a third sheet can executed, and so on up to a desired number of sheets.

As described above, in the second embodiment, when the reversal transport of the sheet is executed in the two-sided printing, the guide member 501 can move to the retreat position so as to reduce the pushing force to the sheet. Therefore, it is possible to prevent the transport obliquely. As a result, it is possible to prevent the gap of the printing position between the surface and the reverse face of the sheet. Additionally, since the guide member 501 can move to the retreat position before the predetermined time of the starting of the reverse transport of the sheet, it is possible to prevent the transport obliquely of the sheet that can be caused by the sheet contacting the guide member 501 just before starting of the reverse transport, even if curling of the sheet is bigger than usual.

As described with reference to the first embodiment, the guide members 501 can move so as to leave the sheet during the reverse transport of the sheet and provide a clearance between the guide members and the sheet. As a result, the sheet can be transported without pushing force of the guide members 501 during the reverse transport of the sheet.

Also, not only the rigid plastic but also a plastic film can be included in the guide member 501. Since the plastic film has elasticity and flexibility, if the plastic film at least partly to form the guide member 501 instead of the rigid plastic, it can reduce the pushing force to the sheet.

Also, not only the solenoid but also a combination of a motor with a cam mechanism or a link mechanism can be used as the actuator that switches the position of the guide member 501. When the motor is used as the actuator, it is possible to prepare plural retreat positions of the guide member 501.

Also, not only two members but also one member or more than two members may be used as the guide member 501. If, for example, the two guide members 501 are arranged symmetrically in the width direction of the sheet, it is possible to evenly guide the sheet by contact on the left and right sides.

In the above-described embodiments, the electro-photographic printers 100*a* and 600*a* that use the LED head have been described as examples of the image forming apparatuses 100 and 600. However, the embodiments can be applied to various types of image forming apparatuses, including, for example, apparatuses that use a laser head or an intermediate transfer method.

What has been described above includes examples of embodiments represented by the appended claims. It is, of course, not possible to describe every conceivable combination of components or methodologies encompassed by the claims, but it should be understood that many further combinations and permutations are possible. Accordingly, the claims are intended to embrace all such combinations, permutations, alterations, modifications and variations that fall within the spirit and scope of the claims. Moreover, the above description, and the Abstract, are not intended to be exhaustive or to limit the spirit and scope of the claims to the precise forms disclosed.

What is claimed is:

1. An image forming apparatus, comprising:

a transport member configured to transport a sheet in a first direction in which the sheet is ejected from the image forming apparatus, and in a second direction in which the sheet is drawn back into the image forming apparatus;

a guide member configured to guide a predetermined surface of the sheet transported by the transport member and to be movable to a first position and a second position, the guide member applying a first pressure on the predetermined surface at the first position, and applying a second pressure lower than the first pressure on the predetermined surface or facing the predetermined surface out of contact therewith at the second position;

a switching unit configured to move the guide member;

a controller configured to control the switching unit so as to move the guide member from the first position to the second position at or before the time when the sheet is transported in the second direction by the transport member; and a sheet receiver configured to receive the sheet ejected from the image forming apparatus thereon;

wherein the guide member has a first end at which a shaft is provided and a second end opposite to the first end, the shaft being moved by the switching unit, the second end lying downstream of the transport member in the first direction, and being further away from the sheet receiver when the guide member is at the second position than when the guide member is at the first position.

2. The image forming apparatus of claim 1, wherein:

the transport member includes a first ejection roller, and a second ejection roller that is in contact with the first ejection roller so that a contact portion is defined therebetween; and an angle between a tangent line at the contact portion and a guide face of the guide member is smaller when the guide member is at the second position than when the guide member is at the first position.

3. The image forming apparatus of claim 1, wherein the switching unit changes a direction in which the sheet is transported by the transport member.

4. The image forming apparatus of claim 1, wherein the switching unit includes a first switching unit that moves the guide member, and a second switching unit that changes a direction in which the sheet is transported by the transport member.

5. The image forming apparatus of claim 1, wherein the guide member projects in the first direction.

6. The image forming apparatus of claim 1, wherein the switching unit includes an actuator, and a connection member that connects the actuator and the guide member.

7. The image forming apparatus of claim 6, wherein the guide member further has a swing axis provided between the first and second ends, the shaft being connected to the connection member, the swing axis swingably supporting the guide member.

8. The image forming apparatus of claim 6, wherein the actuator includes a solenoid.

9. The image forming apparatus of claim 1, further comprising a biasing member configured to bias the switching unit so that the guide member is moved to the first position.

10. An image forming apparatus, comprising:

a transport member configured to transport a sheet in a first direction in which the sheet is ejected from the image forming apparatus, and in a second direction in which the sheet is drawn back into the image forming apparatus;

a guide member configured to guide a predetermined surface of the sheet transported by the transport member and to be movable to a first position and a second position, the guide member applying a first pressure on the predetermined surface at the first position, and applying a second pressure lower than the first pressure on the predetermined surface or facing the predetermined surface out of contact therewith at the second position;

a switching unit configured to move the guide member; and a controller configured to control the switching unit so as to move the guide member from the first position to the second position at or before the time when the sheet is transported in the second direction by the transport member;

wherein the switching unit includes an actuator, and a connection member that connects the actuator and the guide member; and wherein the guide member has a first end at which a shaft is provided, a second end opposite to the first end, and a swing axis provided between the first and second ends, the shaft being connected to the connection member, the swing axis swingably supporting the guide member.

* * * * *